United States Patent [19]

Clark

[11] 4,403,894

[45] Sep. 13, 1983

[54] ROCK BOLT EXPANSION ANCHOR HAVING WINDENED EXPANSION RANGE

[75] Inventor: Carl A. Clark, Liverpool, N.Y.

[73] Assignee: The Eastern Company, Naugatuck, Conn.

[21] Appl. No.: 232,472

[22] Filed: Feb. 9, 1981

[51] Int. Cl.[3] ..... F16B 13/06

[52] U.S. Cl. ..... 411/47; 411/44; 411/67

[58] Field of Search ..... 411/44, 45, 47, 49, 411/50, 52, 55, 56, 60, 63, 71, 72, 67, 24, 26, 46, 57, 61, 64

[56] References Cited

U.S. PATENT DOCUMENTS

| | | | |
|---|---|---|---|
| 1,650,956 | 11/1927 | Ogden et al. | 411/52 |
| 2,870,666 | 1/1959 | Dempsey | 411/67 |
| 3,248,998 | 5/1966 | Siegel | 411/67 |
| 3,678,535 | 7/1972 | Charles | 411/339 X |
| 3,726,181 | 4/1973 | Dickow et al. | 411/67 |
| 4,015,505 | 4/1977 | Murray | 411/57 |
| 4,100,748 | 7/1978 | Hansen | 411/47 X |
| 4,158,983 | 6/1979 | Amico | 411/67 X |
| 4,278,006 | 7/1981 | Lobello | 411/47 |
| 4,339,217 | 7/1982 | Lacey | 411/55 |

FOREIGN PATENT DOCUMENTS

| | | | |
|---|---|---|---|
| 2556019 | 6/1977 | Fed. Rep. of Germany | 411/57 |
| 1194305 | 5/1959 | France | 411/55 |
| 711711 | 7/1966 | Italy | 411/24 |
| 6507571 | 8/1966 | Netherlands | 411/45 |
| 1071556 | 6/1967 | United Kingdom | 411/44 |
| 1409662 | 10/1975 | United Kingdom | 411/64 |
| 1501509 | 2/1978 | United Kingdom | 411/45 |

*Primary Examiner*—Cornelius J. Husar
*Assistant Examiner*—Lloyd A. Gall
*Attorney, Agent, or Firm*—Charles S. McGuire

[57] ABSTRACT

An expansion anchor including an expansible shell and tapered nut for insertion into a drill hole in a rock formation and adapted for outward expansion of the shell into gripping engagement with the drill hole wall to support a rock bolt and bearing plate engaging the rock formation surface around the hole. The invention resides in a novel arrangement of dimensional and structural relationships of the expansion shell and tapered nut which allow the same anchor to be used in drill holes over a range of diameters approximately three times that of conventional prior art anchors of the same general type.

9 Claims, 3 Drawing Figures

ROCK BOLT EXPANSION ANCHOR HAVING WINDENED EXPANSION RANGE

BACKGROUND OF THE INVENTION

The present invention relates to expansion anchors for securing rock bolts in drill holes in mines or other rock formations, and more specifically to novel expansion anchors suitable for use in drill holes of more than one nominal diameter, i.e., over a wider range of drill hole diameters.

Expansion anchors are among the more common means of firmly securing rock bolts within drill holes in rock formations so that the bolt may be tensioned against a bearing plate engaging the rock surface surrounding the hole, thereby stabilizing the rock formation. Such anchors conventionally include an expansion shell which is forced radially outward into gripping engagement with the wall of the drill hole by advancement of a tapered nut axially into the shell. The nut is advanced by rotation of the rock bolt with which it is threadedly engaged.

In some prior expansion anchors both the external surface of the nut, or wedge, and the opposing internal surface of the shell are tapered toward the central axis of the anchor. It is also the usual practice to provide means for retaining the shell and nut in assembled relation prior to use, one of the most common of such means being a bail or strap engaging portions of the shell on each side and extending over the large end of the nut, the small end being inserted into the upper end of the shell. A standard rock bolt is threaded into a tapped hole through the central axis of the tapered nut and inserted into a drill hole which has been formed in an upper or side wall of a mine tunnel or other rock formation with the assembled expansion anchor supported on the end of the bolt which is inserted into the hole. The maximum transverse dimension of the anchor assembly must, of course, be no larger than the drill hole diameter; at the same time, however, the outer dimensions of the anchor cannot be significantly smaller than the drill hole diameter or the anchor will simply rotate with the bolt rather than being expanded into engagement with the drill hole wall, and/or will fail to attain the necessary holding force after full expansion.

In order to meet the rather stringent dimensional parameters required to insure the desired operation of the anchors, it has been necessary to form the drill holes wherein a particular anchor is to be used within 1/32" on either side of a nominal diameter. For example, conventional expansion anchors in use at the present time which are intended for use in drill holes having a nominal diameter of 1¼" will operate satisfactorily over a range of actual drill hole sizes from 1.218" to 1.281", or a total range of drill hole size of 0.063". This, of course, requires frequent replacement of drill bits since a relatively small amount of wear results in a drill hole size in which the designated expansion anchor will not operate satisfactorily. Also, it is necessary to provide a different expansion anchor for use in drill holes made with bits of nominal sizes only ⅛" apart. Thus, it has been necessry for mines to stock two different and separate models (sizes) of expansion anchors for use in nominal 1¼" holes and in 1⅜" holes. The aforementioned dimensional requirements of the anchors, however, has heretofore prevented the use of a single model of expansion anchor in drill holes of more than one nominal size with a tolerance from that nominal size on the order of + or −1/32".

It is a principal object of the present invention to provide a novel and improved rock bolt expansion anchor which will operate satisfactorily in drill holes over a range of diameters approximately three times that in which prior expansion anchors would satisfactorily operate.

Another object is to provide an expansion anchor which operates in the same general manner as prior anchors, i.e., by axial advancement of a tapered nut into a hollow shell by rotation of the rock bolt, and does not add significantly, if at all, to the cost of prior anchors, yet will operate satisfactorily in drill holes having nominal diameters ⅛" apart.

A further object is to provide a rock bolt expansion anchor which reduces the number of different models or sizes of such anchors which must be stocked by an end user for operation in various size drill holes. p Still another object is to decrease the frequency of changing and sharpening drill bits in mining and similar operations where holes are drilled in rock formations for the insertion of rock bolts with expansion anchors supported thereon.

Other objects will, in part, be obvious and will, in part, appear hereinafter.

SUMMARY OF THE INVENTION

In accordance with the foregoing objects, the present invention contemplates an expansion anchor having the usual tapered nut or wedge, and a hollow expansion shell having a tapered internal surface with means for retaining the wedge and shell in a predetermined relationship prior to use. The inner surfaces of the shell are tapered from the upper end thereof toward the central axis for a predetermined portion of the axial length of the shell, as has previously been done, but the shell is provided with a steeper angled taper or beveled portion for a relatively short distance immediately adjacent its upper end. The tapered nut is longer in relation to the length of the associated shell than in similar prior art anchors, and the taper of the external surface of the nut from the small toward the large end thereof is at a steeper angle. Also, the nut is provided, immediately adjacent its smaller end, with a steeper angled taper or chamfered portion for a portion of its axial length equal to the distance of the beveled portion of the shell.

In the illustrated embodiment, the shell includes two separate portions o; shell halves, termed fingers, which are connected by a strap or bail. The strap is attached at opposite ends to the two fingers and has a medial portion extending over and engaging the large end of the tapered nut to hold the latter in assembled relation with the shell. Each shell half includes portions which limit the extent of movement thereof toward the other half, thereby limiting the minimum external dimensions of the shell. The relative dimensions of the nut and shell are such, as will later become apparent, that the small, or lower, end of the nut is inserted into the upper end of the shell by a distance equal to the axial length of the steeper bevel on the inside of the shell and chamfer on the nut as the nut and shell are maintained in assembled relation by the strap prior to use.

DETAILED DESCRIPTION

Figure 3:
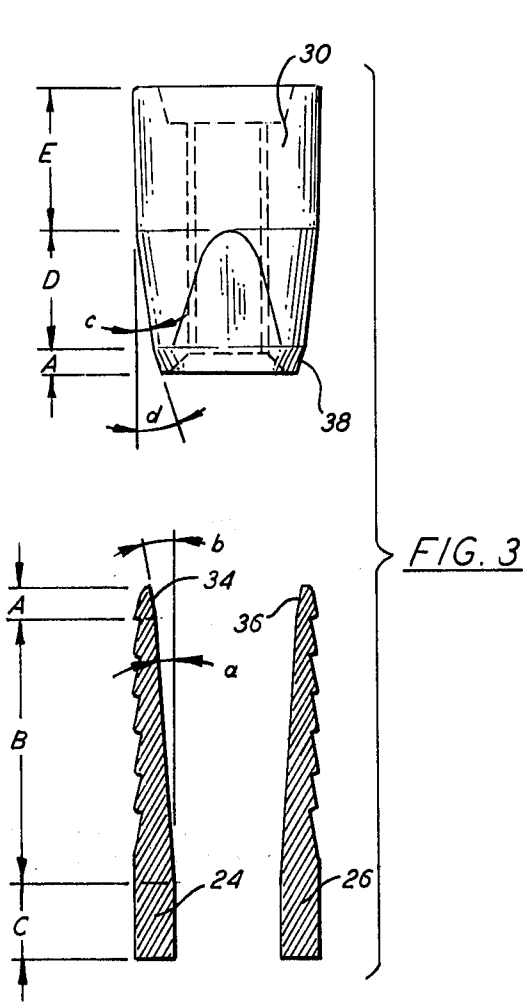
FIG. 3 is an elevational view showing the shell and nut portions of the expansion anchor in separated relation, prior to use, with the shell portion shown in section.

Referring now to the drawing, reference numeral 10 denotes a drill hole in rock formation 12 having a diameter of, e.g., $1\frac{1}{4}''$. Rock bolt 14 is of standard construction, forming no part of the present invention, having head 16 at one end and threads 18 extending from the other end for a portion of its length. Bearing plate 20, of any conventional design, is supported by bolt head 16, normally with a hardened washer inserted therebetween. Rock bolt 14 is inserted in drill hole 10 with an expansion anchor, generally denoted by reference numeral 22, on the threaded end thereof which is anchored in the drill hole by engagement of the expansion anchor with the drill hole wall to allow tensioning of the bolt head against bearing plate 20, thereby stabilizing rock formation 12.

Figure 1:
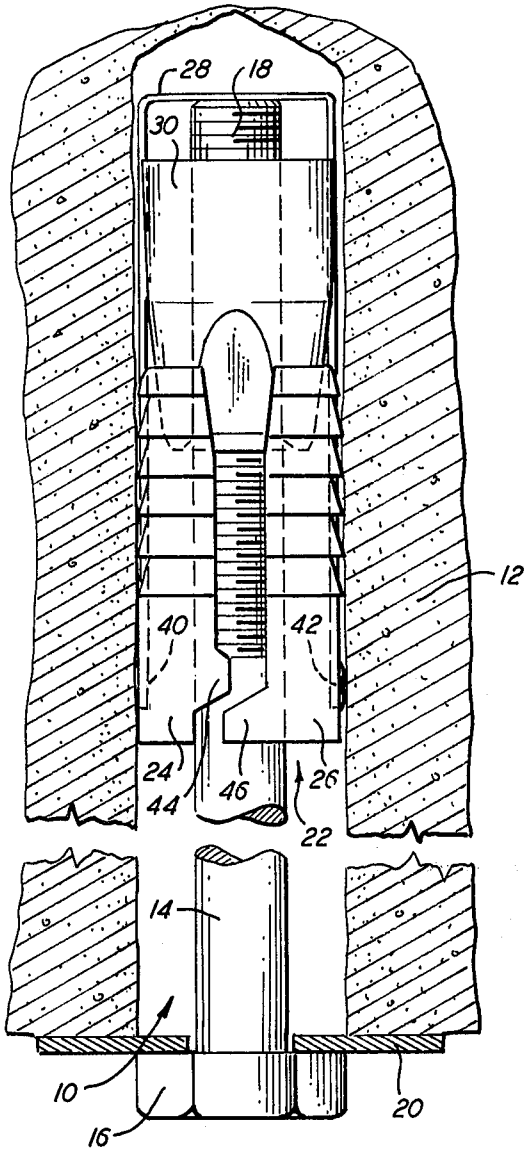
FIG. 1 is an elevational view of the expansion anchor of the invention with associated rock bolt and bearing plate shown fully engaged in a drill hole of a first diameter in a rock formation which is shown in section.

Anchor 22 includes a hollow expansion shell which, in the illustrated embodiment, is formed of two identical halves 24 and 26, joined together by strap 28 which is attached by any desired, conventional means at its opposite ends to portions of the shell halves. The anchor assembly also includes tapered nut 30, both the shell halves and nut preferably being malleable iron castings and strap 28 of sheet steel. Nut 30 has an opening which is centrally located with respect to its axis, and which is tapped to provide female threads for engagement with threads 18 of bolt 14. As seen in FIG. 1, a fully assembled anchor 22 (i.e., shell halves 24 and 26 joined by strap 28 and nut 30 retained on the shell by the strap) has been threaded onto the end of bolt 14 and inserted into drill hole 10. Bolt 14 is advanced into hole 10 until bearing plate 20, which has previously been placed on the bolt, is engaged against the surface of rock formation 12 immediately surrounding the entrance of hole 10 therein. Bolt 14 is then rotated while anchor 22 remains rotationally stationary. This advances nut 30 axially down bolt 14, forcing shell halves 24 and 26 radially outwardly and causing the teeth on the exterior surfaces of each shell half to bite into the internal surface of drill hole 10. Anchor 22 is thus firmly engaged to allow tensioning of bolt 14 to a desired degree.

Figure 2:
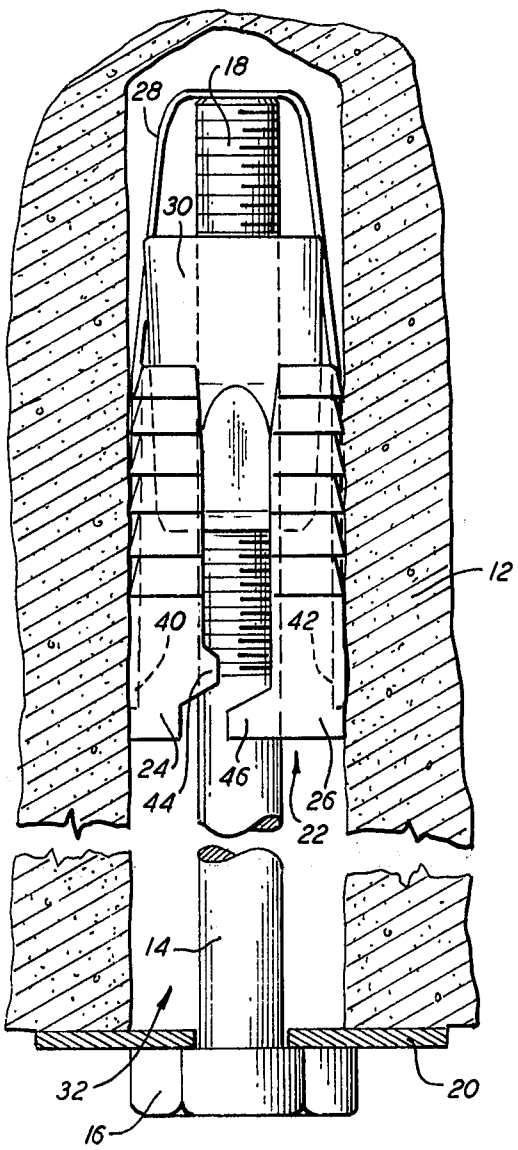
FIG. 2 is an elevational view, as in FIG. 1, showing the same expansion anchor fully engaged in a drill hole of a second diameter, approximately $\frac{1}{8}''$ larger than the first.

In FIG. 2 anchor 22 is shown fully engaged in drill hole 32 having a nominal diameter of $1\frac{3}{8}''$. Reference numerals common to those of FIG. 1 are used since all components of the anchor, bolt, etc. are identical in both drawings, only the size of the drill hole being different. Nut 30 is, of course, drawn further down threads 18 to effect wider expansion of shell halves 24 and 26. The axial length of the tapered nut is greater in relation to shell length in the anchor of the present invention than in prior anchors of similar design. For example, the shell is preferably on the order of $1\frac{1}{4}$ times the length of nut 30, as opposed to shell lengths about $1\frac{1}{2}$ times that of the associated nut in conventional expansion anchor designs. However, simply making the nut longer with the taper carried out to a wider diameter at the large end will not, in itself, render the anchor operational in drill holes over a wider range of sizes. The relationships of the component parts when the anchor is assembled, prior to use, must be carefully controlled in order to insure proper operation in the larger drill holes while maintaining overall dimensions within the limits required for insertion and operation in the smaller drill holes.

One of the major distinguishing features of the anchor of the present invention which permits a design operational over a wider range of drill hole sizes is the provision of mating portions of the shell and nut at the respective ends thereof which are in contact when the anchor is fully assembled, but prior to use, i.e., prior to any expansion of the shell halves. This feature is most evident in FIG. 3 wherein beveled portions 34 and 36 are seen in sectioned shell halves 24 and 26, respectively, and chamfered portion 38 at the smaller end of nut 30. The axial lengths of portions 34, 36 and 38 are equal, all being designated as dimension 'A'. The inner surfaces of shell halves 24 and 26 are tapered from one end thereof, termed the upper end since it is the top end when inserted into a vertical drill hole, as in FIGS. 1 and 2, toward the central axis of the anchor. The axial length of the tapered portion, which is the same in both shell halves, beginning at its juncture with beveled portions 34 and 36 is designated as dimension 'B'. Since shell halves 24 and 26 form portions of a circle in cross section, and the inner surfaces are tapered continuously over the full circumferential extent of both shell halves, the tapered portions form a frustum, the angle of which with respect to the central axis of the anchor is denoted angle 'a' and is preferably about 4.96°. The angle of beveled portions 34 and 36 with respect to the central axis of anchor 22 is denoted angle 'b' and is somewhat greater than angle a. The inner surfaces of shell halves 24 and 26 are cylindrical over axial dimension 'C' from the lower ends to the point where the tapered portions begin.

Nut 30 is tapered over a portion of its axial length designated as dimension 'D', beginning at chamfered portion 38. Preferably, nut 30 is circular in cross section over the remainder of its axial length, designated as dimension 'E', being either cylindrical or having a slight draft, e.g., $\frac{1}{2}°$, as is customary in cast parts which must be removed from molds. The tapered portion is preferably formed as four equally spaced flat areas extending from a widest dimension at the juncture with the chamfered portions to a narrower radius at the upper end of the taper. The angle of the faces of the four flats with respect to the central axis of nut 30 is denoted as angle 'c' and is preferably about 7°5'. The angle of chamfered portion 38 with respect to the central axis is denoted as angle 'd' and is somewhat greater than angle c.

The anchor is assembled by attaching end portions 40 and 42 of strap 28 to shell halves 24 and 26, and placing nut 30 with its smaller end in engagement with the upper end of the shell halves. In this position, strap 28 extends through open slots in the sides of each shell half, and through indented slots in the sides and top of nut 30, whereby the strap does not extend outwardly at any position from the peripheral limits of the anchor. Shell halves 24 and 26 are moved toward one another as closely as possible, i.e., to the extent permitted by portions 44 and 46, and may be retained in this position by a rubber or plastic band. The dimensions of the parts are such that the smaller end of nut 30 will enter the upper end of shell halves 24 and 26 by an axial extent equal to dimension A. That is, when anchor 22 is fully assembled and placed upon, or ready to be placed upon threads 18 of bolt 14, strap 28 holds nut 30 in engagement with the upper end of the two shell halves and chamfered portion 38 of the nut rests upon beveled portions 34 and 36 of the shell halves. Any further movement of nut 30 downwardly between the shell halves 24 and 26 causes radially outward movement of the latter.

An anchor which will operate satisfactorily in drill holes from 1.225" to 1.4060" may be made in the manner described with the aforementioned angles of shell and nut tapers, and the following dimensions:

| | |
|---|---|
| Dimension A | 3/16" |
| Dimension B + A | 1.533" |
| Demension C | .842" |
| Dimension D + A | .938" |
| Dimension E | .938" |
| Nut diameter at upper end | 1.190 |
| Nut diameter at lower end (across flats) | .875 |
| Shell diameter, upper end, inside | .9375 |
| outside | 1.156 |
| lower end, inside | .672 |
| outside | 1.156 |

Although no specific values have been given for angles b and d, both the bevel on the shell halves and chamfer on the nut are formed by steepening the adjacent taper by 1/32" over the 3/16" length of dimension A. That is, the diameter of the nut at the lower (small) end is 1/16" less (1/32" on each side) than it would be if the 7°5' taper were continued to the small end of the nut without the chamfer. The same applies to the bevel at the upper end of the shell halves. The assembly must pass a 1.225 ring gauge. Sharp corners at the upper inside edges of the shell halves may be broken at, e.g., a 45° angle, which is conventional practice and not concerned with the present invention.

Thus, the expansion anchor just described will operate over a 0.181" range of drill hole sizes, being suitable for use in both nominal 1¼" and 1⅜" holes with normal hole tolerances. By comparison, a standard rock bolt expansion anchor for use in nominal 1¼" drill holes will operate satisfactorily over a range of only 0.063", from 1.218" to 1.281". The operating range of the anchor of the present invention is, therefore, substantially three times as great as that of similar prior art anchors. The tapered nut extends 3/16" into the shell, as previously mentioned, prior to any shell expansion, 9/16" when the shell is fully engaged in a 1¼" drill hole, 1 1/16" when the shell is fully engaged in a 1⅜" hole, and 2 1/16" at maximum possible shell expansion.

What is claimed is:

1. An expansion anchor assembly for insertion in a rock formation drill hole having a diameter which may vary between relatively wide dimensional limits, said assembly being effective to expand into engagement with the surrounding wall of said drill hole and provide at least a minimum desired holding force over the entire range of dimensional limits of said drill hole diameter, said assembly comprising:

(a) a hollow expansion shell having upper and lower ends and a plurality of portions arranged concentrically about a central axis;

(b) a nut having upper and lower ends and an internally threaded, central opening extending therethrough;

(c) each of said portions having an internal surface facing said central axis and tapered from said upper end of said shell toward said central axis at a first angle for a first axial portion of its length and at a second angle for a second axial portion of its length;

(d) said nut having an external surface tapered from said lower end thereof away from the axis of said opening at a third angle for a first axial portion of its length, substantially equal to the length of said first axial portion of said shell portions, and at a fourth angle for a second axial portion of its length;

(e) said first angle being greater than said second angle, and said third angle being greater than said fourth angle; and (f) means retaining said shell portions and nut in assembled relation prior to expansion with said lower end of said nut inserted into said upper end of said shell by a distance substantially equal to said first axial portion of the length of each of said shell and nut, the surfaces of said shell and nut in said first axial portions of each being in contact;

(g) the relative lengths of said first and second axial portions of said shell portions and said nut, and the values of said first, second, third and fourth angles permitting expansion of said assembly from an initial diameter prior to expansion, to a minimum expanded diameter in engagement with the surrounding wall of a drill hole of a first diameter, and to a maximum expanded diameter in engagement with the surrounding wall of a drill hole of a second diameter, the difference between said minimum and maximum diameters being at least ⅛".

2. The invention according to claim 1 wherein each of said second axial portions is at least four times each of said first axial portions.

3. The invention according to claim 1 wherein the difference between said minimum and maximum diameter is approximately 3/16".

4. The invention according to claim 3 wherein said minimum and maximum diameters are substantially 1.225" and 1.4060", respectively.

5. The invention according to claim 4 wherein said anchor assembly will pass a 1.225" ring gauge.

6. The invention according to claim 1 wherein said nut is tapered in said second axial dimension at said fourth angle on four flat faces formed at equally spaced intervals about a frustum-shaped surface.

7. The invention according to claims 1, 2 or 5 wherein the number of said shell portions is two.

8. The invention according to claim 1 wherein the length of said first axial portion of each of said shell and nut is substantially 3/16" and the difference between said minimum and maximum diameter is approximately 3/16".

9. The invention according to claim 8 wherein said second and fourth angles are substantially 4.96° and 7°5', respectively.

* * * * *